US005611759A

United States Patent [19]

Zeh et al.

[11] Patent Number: 5,611,759

[45] Date of Patent: Mar. 18, 1997

[54] RESISTANCE DEVICE FOR BICYCLE TRAINERS

[75] Inventors: Mark A. Zeh, Wayzata; George D. Stickler, Shorewood, both of Minn.; Jeffrey C. Nichols, New York, N.Y.

[73] Assignee: Cycle-Ops Products, Inc., New York, N.Y.

[21] Appl. No.: 494,503

[22] Filed: Jun. 26, 1995

[51] Int. Cl.[6] ..... A63B 22/06; A63B 69/16

[52] U.S. Cl. ..... 482/61; 482/112

[58] Field of Search ..... 482/57, 61, 58, 482/111, 112, 113

[56] References Cited

U.S. PATENT DOCUMENTS

| | | | |
|---|---|---|---|
| 3,373,992 | 3/1968 | Ludeman | 272/73 |
| 3,494,616 | 2/1970 | Parsons | 272/73 |
| 4,171,802 | 10/1979 | Stoecker | 272/67 |
| 4,645,199 | 2/1987 | Bloemendaal | 482/58 |
| 4,741,529 | 5/1988 | Bloemendaal | 272/130 |
| 4,768,782 | 9/1988 | Blackbarn | 482/61 |
| 4,822,037 | 4/1989 | Makansi et al. | 272/129 |
| 5,195,936 | 3/1993 | Mao | 482/112 |
| 5,472,392 | 12/1995 | Haan et al. | 482/61 |

*Primary Examiner*—Stephen R. Crow
*Attorney, Agent, or Firm*—Dorsey & Whitney LLP

[57] ABSTRACT

The present invention is directed to a bicycle trainer that permits a bicycle to be used for stationary riding. The bicycle trainer has a modular fluid resistance unit operates by the rotation of an impeller against a fluid contained inside a sealed housing. The resistance unit provides increasing resistance as the rotational speed of the impeller is increased, is quiet to use, and simulates bicycle riding on a road.

2 Claims, 4 Drawing Sheets

RESISTANCE DEVICE FOR BICYCLE TRAINERS

BACKGROUND OF THE INVENTION

The present invention relates generally to a training device for use with bicycles, and more particularly to the resistance unit of the bicycle trainer.

For many years, bicycle trainers have been used by bicycling enthusiasts to convert their bicycles for stationary riding. Rather than ride in cold or rainy weather, the cyclist can use the trainer to ride indoors and obtain an aerobic, cardiovascular workout. Bicycle trainers also obviate the need for purchasing a separate stationary bicycle for those persons who want to occasionally workout while, for example, reading or watching television. Regardless of the reasons for its use, a bicycle trainer should be easy to use and, to the extent possible, simulate bicycle riding on the open road.

To provide the user with a workout that simulates riding on the open road, a bicycle trainer must be designed with a resistance unit that can provide increasing resistance to match the energy output of the rider. Presently, many conventional bicycle trainers do not simulate bicycle riding well because of the design limitations of their resistance units.

A typical bicycle trainer has a frame onto which the user mounts the bicycle. The rear wheel of the bicycle is contacted with a roller that is, in turn, connected to a resistance unit. Resistance to the rotation of the rear wheel may be adjustable, but, in any event, must provide smooth action at various speeds. In addition, the resistance unit must provide increased resistance as the rotation the wheel is increased, so that more energy is required to pedal the bicycle and the rider receives a greater workout.

The existing technologies used to provide resistance include: frictional systems that use, for example, belts and pulleys; magnetic systems that use permanent and electromagnetics; and fan units. Resistance units that employ these technologies often do not provide smooth action at varying speeds and can also be very noisy.

It is known that fluids can be used as a medium for providing resistance. However, there is presently no bicycle trainer available that effectively use a fluid in a resistance unit.

SUMMARY OF THE INVENTION

It is an object, therefore, of the present invention to provide a bicycle trainer with a fluid resistance unit offers progressive resistance to match the energy output of the user.

Another object of the present invention is to provide a fluid resistance unit that is modular and quiet.

Accordingly, the present invention is directed to a trainer having a frame for supporting a bicycle, and a rider mounted thereon, and having a movable, modular fluid resistance unit that is attached to the frame. The resistance unit is moved so as to be positioned in frictional engagement with the rear wheel of the bicycle.

In particular, a rotatable shaft engages and is rotated by the rear wheel. The rotatable shaft is connected at one end to an impeller that is encased by a sealed housing that contains a fluid. The fluid provides resistance against the rotational movement of the impeller in the housing. At its other end, a flywheel may be attached to the rotatable shaft to provide the simulated momentum of a bicycle.

Additional objects and advantages of the invention will be set forth in the description which follows, and as particularly pointed out in the claims.

BRIEF DESCRIPTION OF THE DRAWINGS

The accompanying drawings, which are incorporated in and constitute a part of the specification, schematically illustrate the embodiments of the invention and, together with the general description given above and the detailed description of the preferred embodiment given below, serve to explain the principles of the invention.

DESCRIPTION OF THE PREFERRED EMBODIMENTS

The present invention will be described in terms of its various embodiments.

Figure 1:
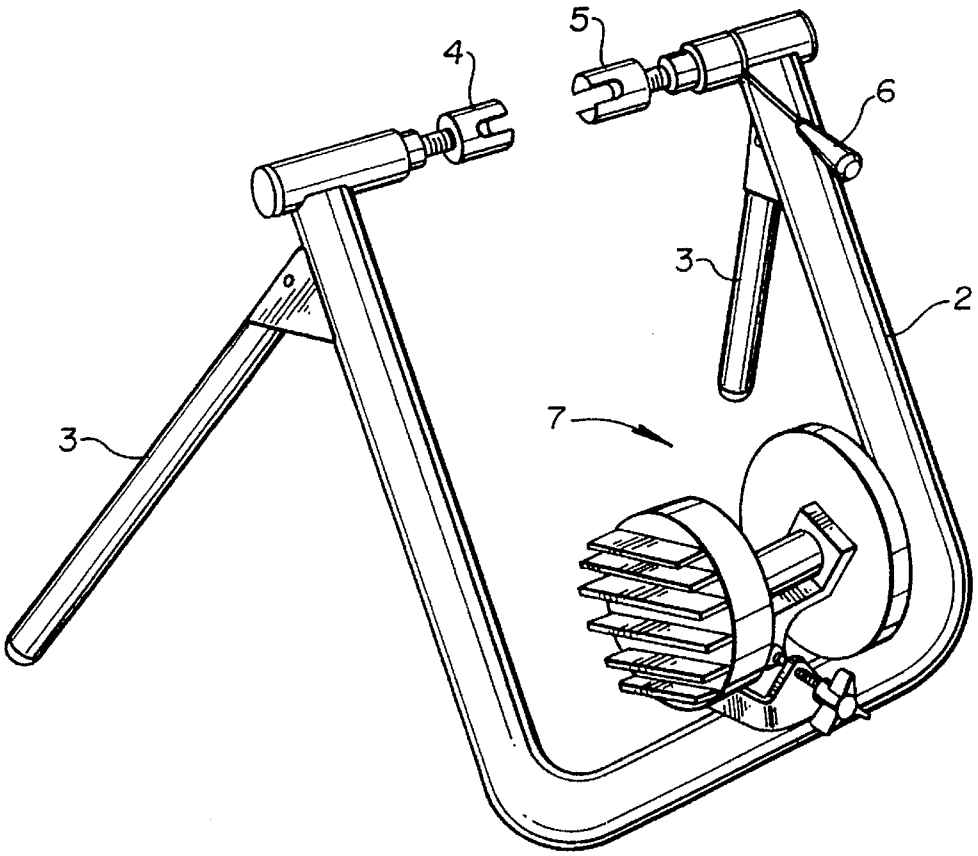
FIG. 1 is a perspective drawing showing the bicycle trainer of the present invention with a fluid resistance unit.

In FIG. 1, a bicycle trainer 1 of the present invention is shown ready for use. In this embodiment, the bicycle trainer 1 has a U-shaped frame 2 and retractable legs 3 that provide a stable base. Legs 3 fold in towards frame 2 to allow bicycle trainer 1 to be easily stored. The frame of the bicycle trainer can be made in a variety of configurations, provided the bicycle and rider are held in a stable, upright position.

Figure 2:
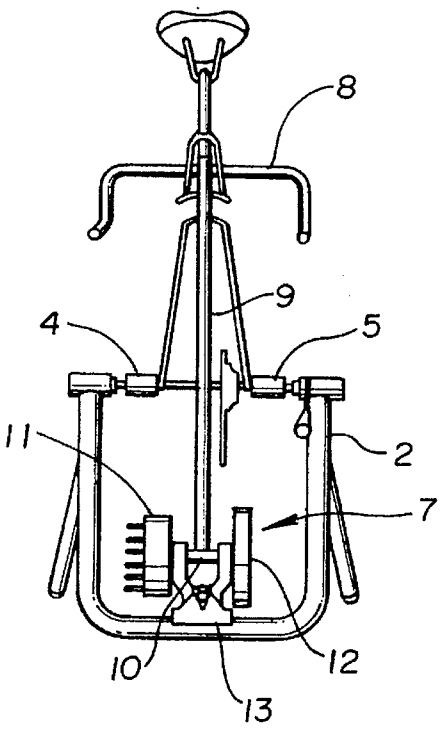
FIG. 2 is a drawing of the invention shown in FIG. 1 with a bicycle positioned for use by a rider.

As shown in FIG. 2, rear wheel 9 of bicycle 8 is held in place by clamps 4 and 5. The position of clamp 4 is fixed and clamp 5 is movable by means of handle 6, and together they allow bicycle 8 to be positioned and securely held. Fluid resistance unit 7 is shown having a rotating shaft 10, which is in frictional contact with rear wheel 9, an impeller unit 11 and a fly wheel 12. Fluid resistance unit 7 is designed to be a movable modular unit, which is attached to frame 2 by yoke 13. The modular design allows fluid resistance unit 7 to be separately manufactured and later assembled with the other components of bicycle trainer 1.

Figure 3:
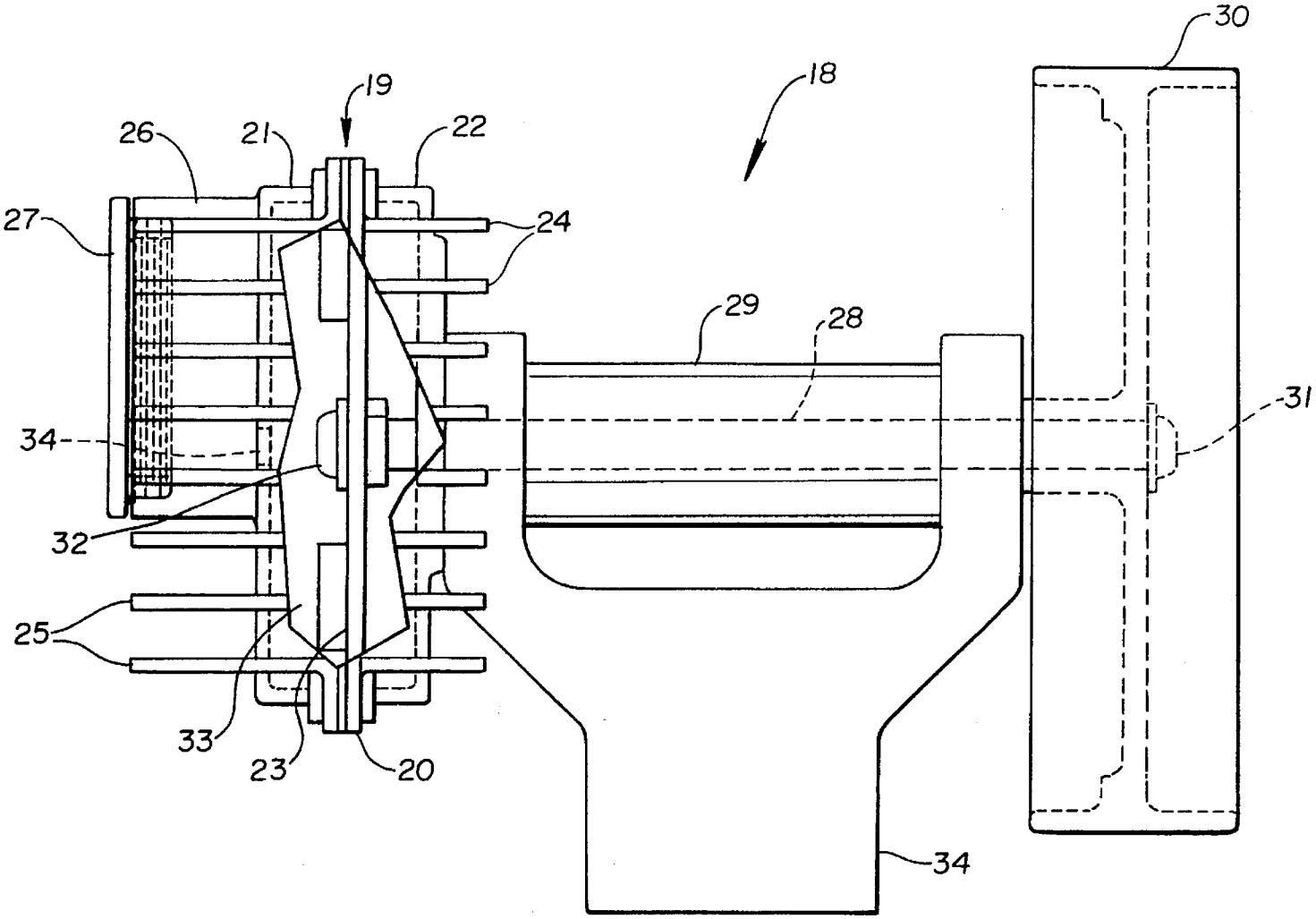
FIG. 3 is a front view of an alternative embodiment of the resistance unit of the present invention with a cutaway of the housing.
Figure 5:
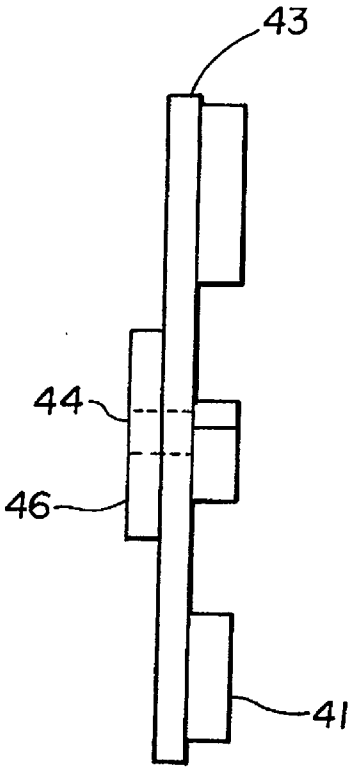
FIG. 5 is side view of the impeller shown in FIG. 4.

A preferred embodiment of fluid resistance unit 18 is shown in FIG. 3. Impeller unit 19 is shown with a cutaway section to reveal impeller 23, which is housed inside. Impeller unit 19 has a housing 20 comprising a first shell member 21 and a second shell member 22. First shell member 21 and second shell member 22 are fastened together to form a fluid-tight chamber 33. Gaskets are used to maintain the fluid-tight seals of the impeller unit 19. First shell member 21 has expansion chamber 26, which is in fluid communication with fluid chamber 33 via a channel opening 34. It is preferred that channel opening 34 be located near the center of chamber 33.

Expansion chamber 26 provides an area for the resistance fluid to expand and acts as a reservoir for extra fluid as well. The resistance fluid will expand, as result of frictional heat, and the expansion chamber 26 prevents the build up of internal pressure beyond the limits that can be maintained by the fluid-tights seals. If a silicon resistance fluid is used, the relationship between the volumes of expansion chamber and the fluid-tight chamber is approximately 1.5:4.0.

Expansion chamber 26 has a removable capped 27 that is threaded to allow it to be screwed into place. As shown, first shell member 21 has a plurality of cooling vanes 25. Similarly, second shell member 22 has a plurality of cooling vanes 24.

A variety of resistance fluids can be used in the impeller unit of the present invention. Although not an operational requirement, it is preferred that the resistance fluid be non-toxic. Generally, the resistance fluid should have a viscosity in the range of 1 to 500 cs. A larger impeller is required if the viscosity of the fluid is small. The resistance fluids that may be used include silicone compounds, vegetable oils, mineral oils, water-based lubricants, etc.

In the preferred embodiment, the fluid used in the resistance unit is silicone compound. Specifically, a pure silicon fluid with a 50 cs viscosity is used because of its high boiling point of about 400° F.

When water is used as the resistance fluid, a small amount of water soluble oil is added to the fluid to provide lubricity and as an anti-corrosive agent. It is important the resistance fluid chosen have a low coefficient of compression.

As shown in FIG. 3 by the cutaway in housing 20, an impeller 23 is situated generally in the center portion of fluid chamber 33. Impeller 23 is oriented within housing 20 in a generally vertical position. Impeller 23 is connected to rotation shaft 28 by a screw 32. Roller 29 iS a sleeve that is placed over shaft 28 to increase the circumference of the frictional contact surface. As shown, impeller 23 is generally a flat circular plate with protruding vanes extending from one side of the plate. This design of the impeller is asymmetrical. It should be understood that the impeller of the present invention can have various configuration without affecting the operations of the resistance unit, including as a propeller, a paddle wheel, a screw, etc. A fly wheel 30 is connected to the opposite end of shaft 28 and is shown attached by screw 31. The entire resistance unit is connected to the trainer frame by yoke 34.

Figure 4:
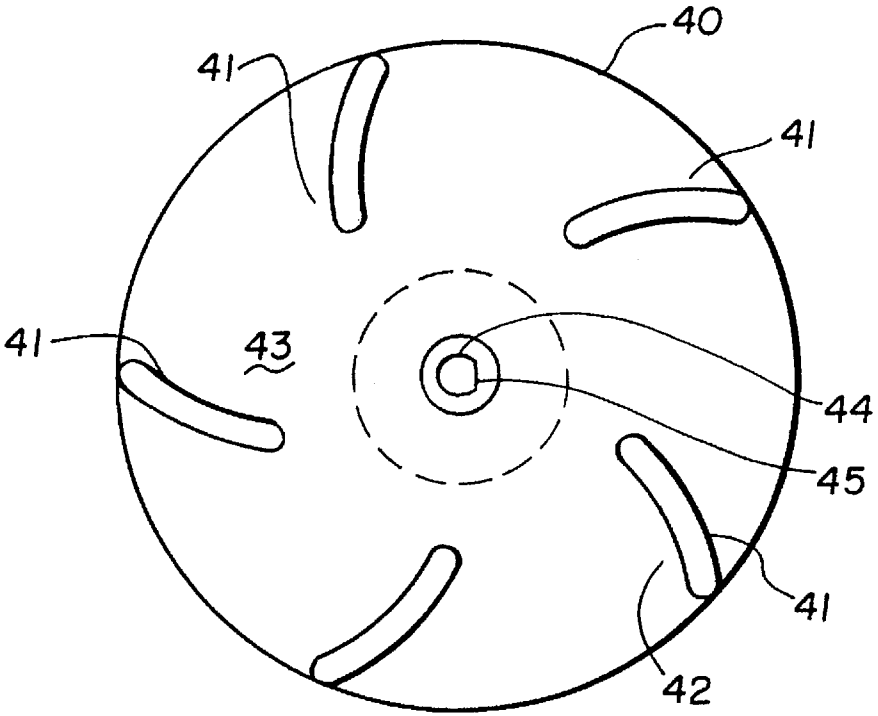
FIG. 4 is a front view of an embodiment of the impeller of the present invention.

A preferred embodiment of the impeller is shown in FIG. 4. Impeller 40 is made of flat plate 43 with a plurality vanes 41. The number of vanes can be varied, depending on the size of the impeller and impeller housing. The number of vanes is determined, in part, by the total surface area needed to provide resistance against the fluid. For a 2.8 inch diameter impeller, the number of-vanes can be in the range of 1 to 8. It is preferred that five (5) vanes be used, each spaced apart equally at approximately 72° along the circumference of the circular plate 43. Vanes 41 have inner surfaces 43 that are concave surfaces that are curved in the direction of rotation. The curved surfaces move the fluid by a scooping action and that provides resistance during rotation. It is preferred that surfaces 42 have radii of approximately 1.188 inches.

The vanes also can be made in a variety of shapes to provide the necessary resistance in the fluid. The lead surface of the vanes can be less streamline to provide more resistance or more streamline to provide less resistance as the impeller rotates in the fluid. It is within the scope of the invention to use vanes that have lead surfaces that are flat, trapezoidal, curved, etc. It is preferred that the lead surface of the vanes be offset at an angle from the radius of the impeller.

As shown, impeller 40 has hole 44 with a beveled portioned 45 that facilitates rotation. The back surface of plate 43 has a raised portion 46. The impeller is preferably made of metal using conventional casting methods. Other materials may be used to make the impeller, including refractory ceramics, plastics, etc.

In preferred embodiment of the present invention, the momentum of the bicycle is simulated by the action of a fly wheel attached to the rotating shaft. The fly wheel rotates in air and is not subjected to the same amount of resistance as the impeller in the fluid. Consequently, the fly wheel is able to maintain a greater rotational momentum during the pedaling cycle when the pedal and crank are in the vertical position and the transfer of power to the rear drive wheel is at a minimum. It is desirable to make the fly wheel as heavy as possible, with most of the weight being at the periphery. On the other hand, if the fly wheel is too heavy, the rear bicycle tire will slip during acceleration due to the inertia of the flywheel. It is preferred, therefore, that the fly wheel have a weight in the range of 0.5 to 4.0 lbs.

Figure 6:
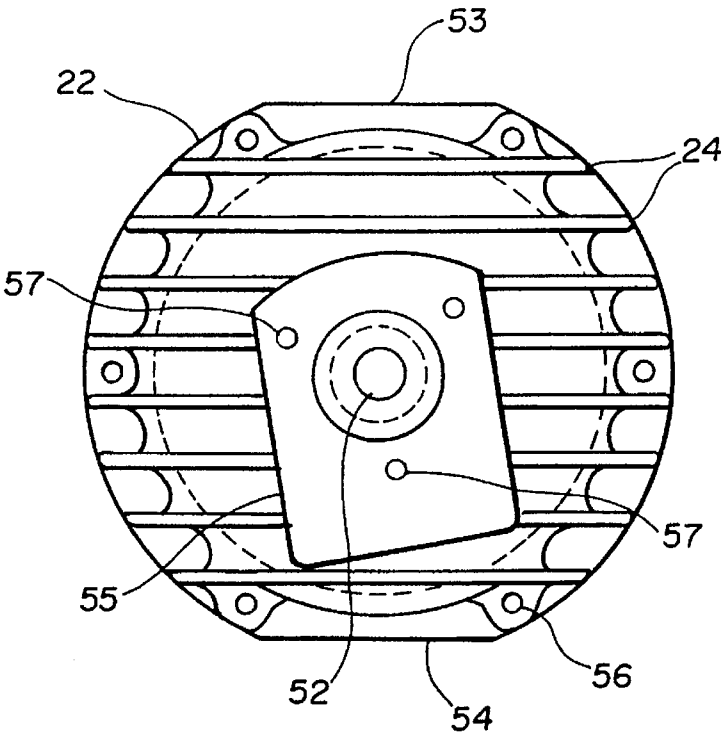
FIG. 6 is a front view of the outer surface of an embodiment of the inner half shell of the impeller housing of the present invention.

In FIG. 6, the front view of second shell member 22 is shown. Shell member 22 has top beveled portion 53 and bottom beveled portion 54. Shell member 22 also has flat portion 55 which is placed in facial contact for mounting on the yoke via screw holes 57.

Figure 7:
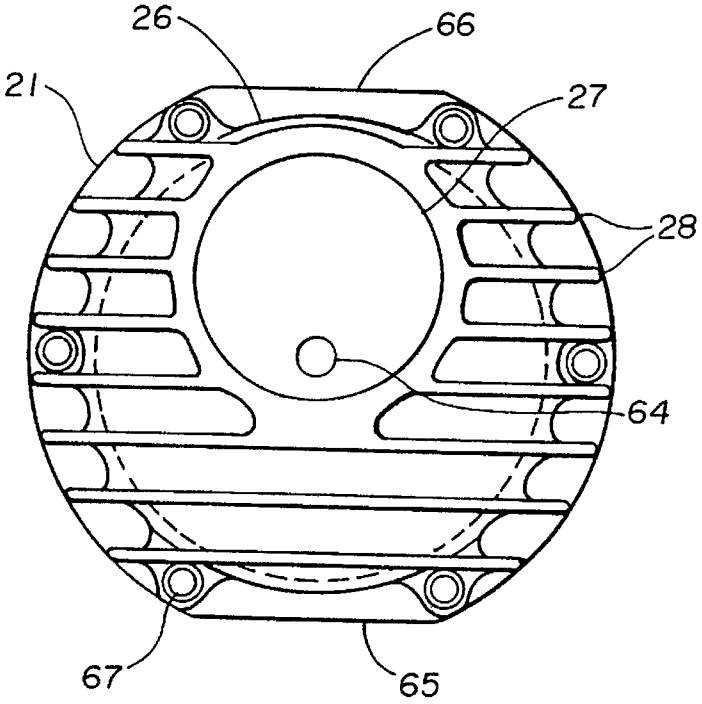
FIG. 7 is a front view of the outer surface of an embodiment of the outer half shell of the impeller housing of the present invention.

In FIG. 7, the front view of first shell member 21 is shown. Shell member 21 has a top beveled portion 66 and a bottom beveled portion 65 that correspond with the second shell member 22. Cap 27 is shown having an indentation 64 that is used to assist in screwing and unscrewing cap 27. Shell member 21 has a plurality screw holes 67 that correspond with screw holes 56 in second shell member 22.

As shown in FIGS. 3, 6 and 7, the outside surface of housing 20 has cooling fins or vanes 24 and 25 that are used to dissipate heat generated by the rotation of impeller 23 in the resistance fluid. The cooling vanes can be place on the outer surfaces of either or both of shell members 21 and 22. The frictional heat that is generated is substantial. Without the use of vanes 24 and 25 to cool housing 20, the housing would be hot and could cause burns if touched. In addition, the fluid-tight seals used in housing 20 could possibly be damaged after extended use due to the heat. The vanes 24 and 25 are shown oriented in a parallel horizonal manner, but the orientation can be varied in a vertical direction or in a radial, non-parallel configuration as well. The spacing between the fins must be sufficient to provide adequate transfer of heat to the surrounding air. The minimum spacing required is approximately 0.300 inches.

It is also within the scope of the invention to place internal baffles on the inner surface of the housing for the impeller unit. The baffles can be place on the inner surfaces of either or both of shell members 21 and 22. The fluid dynamics of the rotation of the impeller are such that when baffles are used, there are no effects until the vanes of the impeller are brought in proximity to the inner wall of the housing. As the distance between the impeller and the housing wall decreases, the shearing action of the action of the fluid increases and the resistance is increased.

One of the advantages of the present invention is the lack of noise generated by the rotation of the impeller in the resistance fluid. The quietness of the impeller unit is due, in part, to the fact that sound does not transmit easily through media having different densities.

The amount of resistance fluid used to fill the housing should be sufficient to cover the vanes of the impeller. The housing is not entirely filled, a small volume of air is left for thermal expansion of the fluid when the trainer is used. When the expansion chamber is not used, there must be room provided for thermal expansion of the fluid, otherwise it is possible that the seal to the housing may be damaged. It is possible to replace the fluid used in the impeller unit to vary the resistance that can be obtained.

Finally, the present invention has been described in terms of preferred embodiments and are considered as illustrative only of the principles of the invention. It is not desire to limit the invention to the exact constructions and operations shown and described, and accordingly all suitable modifications and equivalents may fall within the scope of the invention.

What is claimed is:

1. A resistance applying device for use with a bicycle exercise apparatus having a driven wheel supported by a stationary support frame, said resistance applying device comprising:

a rotatable shaft in operable engagement with said driven wheel, said rotatable shaft being rotated when said driven wheel is rotated;

a rotatable impeller connected to one end of said rotatable shaft; and a sealed housing comprising first and second shell members joined to form a fluid-tight impeller chamber for receiving said rotatable impeller and containing a fluid that provides resistance against the rotation of said impeller, wherein one of said first and second shell members includes an expansion chamber in fluid communication with said impeller chamber, said expansion chamber sealed by a removable cap.

2. A fluid resistance device for a bicycle trainer having a support frame releasably and operably connected to a rear wheel of a bicycle, said resistance device comprising:

a rotatable shaft in frictional contact with said rear wheel and being held in a generally horizontal position by a yoke attached to said frame, said rotatable shaft having first and second ends;

an impeller attached to said first end of said rotatable shaft and having at least one vane, said impeller being rotated by said rotatable shaft;

a sealed housing having a chamber for receiving said impeller and containing a fluid for providing resistance against the rotation of said impeller, said housing having a plurality of cooling fins and being fixably attached to said yoke;

an expansion chamber in fluid connection with said impeller chamber and also containing said fluid; and a flywheel attached to said second end of said rotatable shaft for moving in unison with said impeller.

* * * * *